US005532669A

United States Patent [19]

Tsunezawa et al.

[11] Patent Number: 5,532,669

[45] Date of Patent: Jul. 2, 1996

[54] TERMINAL FOR HIGH-VOLTAGE VARIABLE RESISTOR

[75] Inventors: Ichiro Tsunezawa, Toyama; Hiromasa Saikatsu, Himi; Tsuyoshi Ohta, Toyama, all of Japan

[73] Assignee: Hokuriku Electric Industry Co., Ltd., Kami-Niikawagun, Japan

[21] Appl. No.: 158,943

[22] Filed: Nov. 29, 1993

[30] Foreign Application Priority Data

Nov. 27, 1992 [JP] Japan ..... 4-087639 U

[51] Int. Cl.[6] ..... H01C 1/02; H01C 13/00

[52] U.S. Cl. ..... 338/184; 338/70; 338/273; 338/276; 338/219; 411/519; 411/522

[58] Field of Search ..... 338/118, 273, 338/274, 276, 322, 70, 184, 199, 272, 277, 322, 219; 411/516, 519–520, 521–522; 174/153 G, 267

[56] References Cited

U.S. PATENT DOCUMENTS

| | | | |
|---|---|---|---|
| 913,024 | 2/1909 | Meacham | 174/153 G |
| 2,616,733 | 11/1952 | Strange | 411/516 X |
| 3,182,367 | 5/1965 | Hamann et al. | 411/516 X |
| 3,619,478 | 11/1971 | Staiger | 174/267 |
| 3,796,124 | 3/1974 | Crosa | 411/521 |
| 4,402,037 | 8/1983 | Iwamura et al. | 338/219 X |
| 4,471,339 | 9/1984 | Fukada et al. | 338/184 X |
| 4,834,603 | 5/1989 | Holton | 411/521 |
| 5,278,535 | 1/1994 | Xu et al. | 338/276 X |

FOREIGN PATENT DOCUMENTS

| | | |
|---|---|---|
| 43371 | 3/1982 | Japan . |
| 157075 | 4/1982 | Japan . |
| 130387 | 9/1983 | Japan . |
| 192601 | 12/1987 | Japan . |

OTHER PUBLICATIONS

JP Utility Model Laid–Open Publication No. 86786/1981.

*Primary Examiner*—Marvin M. Lateef

*Attorney, Agent, or Firm*—Pearne, Gordon, McCoy & Granger

[57] ABSTRACT

A high-voltage variable resistor includes a terminal fitment having an increased number of edge elements while being simplified in structure and down-sized. A circuit substrate which includes a circuit pattern having a plurality of electrodes and resistor elements formed thereon is received in a substrate receiving section of an insulating casing. The insulating casing is charged with insulating resin through an opening thereof to form an insulating resin layer on a rear surface of the circuit substrate. Terminal fitments are provided each of which includes a core holding section provided with three or more edge elements biting into a periphery of a core of a lead wire inserted thereinto. The edge elements each are formed between each adjacent two of three or more slits formed at a plate-like section of the terminal fitment so as to radially extend from a center thereof. The edge element, when a core of a lead wire is inserted through the edge elements into the terminal fitment, are forcibly inclined in a direction of insertion of the core, so that application of drawing force to the lead wire permits the edge elements to bite into the core. The edge elements each are formed into a triangle shape, resulting in having a pointed distal end. An increase in the number of edge elements is accomplished by increasing the number of slits.

13 Claims, 6 Drawing Sheets

TERMINAL FOR HIGH-VOLTAGE VARIABLE RESISTOR

BACKGROUND OF THE INVENTION

This invention relates to a high-voltage variable resistor, and more particularly to a high-voltage variable resistor called a focusing pack which is used for adjusting a focusing voltage, a screen voltage or the like in a cathode ray tube (CRT) or the like.

In order that connection of a lead wire for connection between a high-voltage variable resistor and another component to an electrode on a substrate for a circuit (hereinafter referred to "circuit substrate") is carried out in a last step in assembling of the high-voltage variable resistor and a lead wire of a desired length is used for the connection, proposal is made for connecting a core of the lead wire to a terminal fitment fixed on the circuit substrate without soldering.

For example, Japanese Utility Model Application Laid-Open Publication No. 192601/1987 (62-192601) teaches, by way of example, a terminal fitment for electrically connecting a core of a lead wire to an electrode on a circuit substrate without soldering in a high-voltage variable resistor. The terminal fitment disclosed is connected at one end thereof to an electrode incorporated in a circuit pattern formed on a front surface of the circuit substrate and provided at the other end thereof with a core holding section including at least one edge element adapted to bite into an outer periphery of the core of the lead wire inserted thereinto. Unfortunately, the terminal fitment fails in an increase in the number of edge elements required for securely holding the core of the lead wire in the terminal fitment, because the edge element causes the terminal fitment to be complicated in structure. Also, the edge element is formed into an inverted triangle or V shape, resulting in having a pointed or sharpened distal end. An increase in the number of edge elements thus formed into an inverted V shape leads to a significant increase in configuration and dimension of the terminal fitment.

Japanese Utility Model Application Laid-Open Publication. No. 157075/1982 (Japanese Utility Model Application No. 73333/1980) and Japanese Utility Model Application Laid-Open Publication No. 130387/1983 (Japanese Utility Model Application No. 27255/1982) each disclose another terminal fitment for connection of a core of a lead wire thereto, which terminal fitment includes a single edge element adapted to bite into a core of a single lead wire and a spring for biasing the core of the lead wire against a wall of the terminal fitment. The terminal fitment has the disadvantage of failing to securely hold the core of the lead wire therein, to thereby be inconvenient for use for connection of a lead wire to which a high voltage is applied.

A further terminal fitment for connection of a core of a lead wire thereto is disclosed in Japanese Patent Application Laid-Open Publication No. 43371/1982 (Japanese Patent Application No. 50469/1981), which is provided with a single edge element adapted to bite into a core of a lead wire. The terminal fitment likewise fails to firmly hold the core of the lead wire therein, to thereby be unsuitable for use for connection of a lead wire to which a high voltage is applied.

SUMMARY OF THE INVENTION

The present invention has been made in view of the foregoing disadvantages of the prior art.

Accordingly, it is an object of the present invention to provide a high-voltage variable resistor which includes a terminal fitment capable of being increased in the number of edge elements to be provided while being kept simplified in structure and prevented from being large-sized.

It is another object of the present invention to provide a high-voltage variable resistor which includes a terminal fitment capable of exhibiting increased mechanical strength.

It is a further object of the present invention to provide a high-voltage variable resistor which includes a terminal fitment capable of facilitating insertion of a core of a lead wire thereinto and securely biting into the core when drawing force is applied to the lead wire.

It is still another object of the present invention to provide a high-voltage variable resistor which includes a terminal fitment capable of being electrically connected to an electrode on a circuit substrate without soldering.

In accordance with the present invention, a high-voltage variable resistor is provided. The high-voltage variable resistor includes a circuit substrate having a circuit pattern formed on a front surface thereof and an insulating casing made of an insulating resin material and provided therein with a circuit substrate receiving section open at one end thereof, wherein the circuit substrate is received in the circuit substrate receiving section of the insulating casing and arranged so as to define a space between an inner surface of the insulating casing and the front surface of the circuit substrate. The high-voltage variable resistor also includes at least one sliding element arranged in the space in a manner to be operable from an outside of the insulating casing and at least one terminal fitment to which a core of a lead wire is connected without soldering and which is electrically connected to an electrode incorporated in the circuit pattern.

The terminal fitment includes a core holding section provided with three or more edge elements each adapted to bite into a periphery of the core of the lead wire inserted, wherein the edge elements each are formed between each adjacent two of at least three slits formed at a plate-like section of the terminal fitment so as to radially extend from a center of the plate-like section, and the edge elements each are constructed so as to be forced by the core of the lead wire when the core is inserted through the center of the plate-like section into the terminal fitment, to thereby be inclined in a direction of insertion of the core into the terminal fitment and bite into the periphery of the core of the lead wire when drawing force is applied to the lead wire.

The edge elements each are formed into a triangular or V shape, resulting in having a pointed or sharpened distal end. Merely an increase in the number of slits permits the edge elements to be increased in number as desired. Thus, the present invention leads to an increase in the number of edge elements and ensures secure holding of the core of the lead wire in the terminal fitment while keeping a structure of the terminal fitment simplified and preventing large-sizing thereof.

In a preferred embodiment of the present invention, the terminal fitment includes a wall section arranged so as to extend from each of at least three sides of the plate-like section in the direction of insertion of the core. This leads to an increase in mechanical strength of the terminal fitment.

In a preferred embodiment of the present invention, the plate-like section is formed into a substantially rectangular configuration and four such slits are formed so as to extend toward corners of the plate-like section, respectively. Such construction permits the pointed distal end of each of the edge elements to bite into the core of the lead wire in a well-balanced manner, resulting in the core being firmly held in the terminal fitment.

In a preferred embodiment of the present invention, the edge elements each are previously inclined in the direction of insertion of the core of the lead wire into the terminal fitment. This facilitates insertion of the core into the terminal fitment and permits the edge elements to deeply and positively bite into the core when drawing force is applied to the lead wire.

The terminal fitment may be mounted at any desired position. In a preferred embodiment of the present invention, the insulating casing includes at least one terminal fitment receiving section for receiving the terminal fitment therein, wherein the terminal fitment is connected through a conductive connection member to the electrode on the circuit substrate. Formation of the terminal fitment receiving section into a shape of permitting press-fitting of the terminal fitment therein eliminate a necessity of separately providing a means for fixing the terminal fitment. The terminal fitment receiving section may be provided separate from the circuit substrate receiving section or therein.

Arrangement of the terminal fitment receiving section in the circuit substrate receiving section of the insulating casing permits the terminal fitment to be positioned on the electrode on the front surface of the circuit substrate. Thus, the terminal fitment may be contacted directly with the electrode. However, an error in manufacturing of the terminal fitment or thermal contraction or expansion of the insulating casing causes maintaining of direct contact between the terminal fitment and the electrode to be hard. Thus, electrical connection between the terminal fitment and the electrode on the circuit substrate is preferably carried out through an elastic conductive connection member. Elasticity of the conductive connection member effectively absorbs an error in manufacturing of the terminal fitment and thermal variation of the insulating casing. Electrical connection between the terminal fitment and the electrode can be carried out without soldering. Although a coiled spring may be used as the elastic conductive connection member, handling of the coiled spring is troublesome because it easily falls down and rolls. Use of a conductive rubber material as the elastic conductive connection member facilitates handing of the connection member and simplifies incorporation of the connection member. Such a rubber connection member is arranged between the circuit substrate and the terminal fitment while being kept compressed. In this instance, it is preferable that one of the terminal fitment and conductive rubber is provided with a positioning projection and the other is formed with a positioning recess fittedly engaged with the projection. This results in facilitating positioning of the conductive rubber.

The terminal fitment may be mounted on a rear surface of the circuit substrate as well. In this instance, the terminal fitment is partially embedded in the insulating resin layer formed on the rear surface of the circuit substrate, to thereby firmly secure the terminal fitment to the circuit substrate. When a thickness of the insulating resin layer is excessively increased to cause the terminal to enter the insulating resin layer too deeply, the insulating resin layer interferes with movement of the edge elements, resulting in the lead wire tending to be released from the terminal fitment. In order to solve the problem, a preferred embodiment of the present invention may be constructed in such a manner that a portion of the terminal fitment on which the core receiving section is provided is formed thereon with a mark indicting a limit position of charging of the insulating resin for the insulating resin layer. This prevents excessive charging of the insulating resin, to thereby provide the insulating resin layer of an appropriate thickness.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a high-voltage variable resistor according to the present invention will be described hereinafter with reference to the accompanying drawings.

Figure 1:
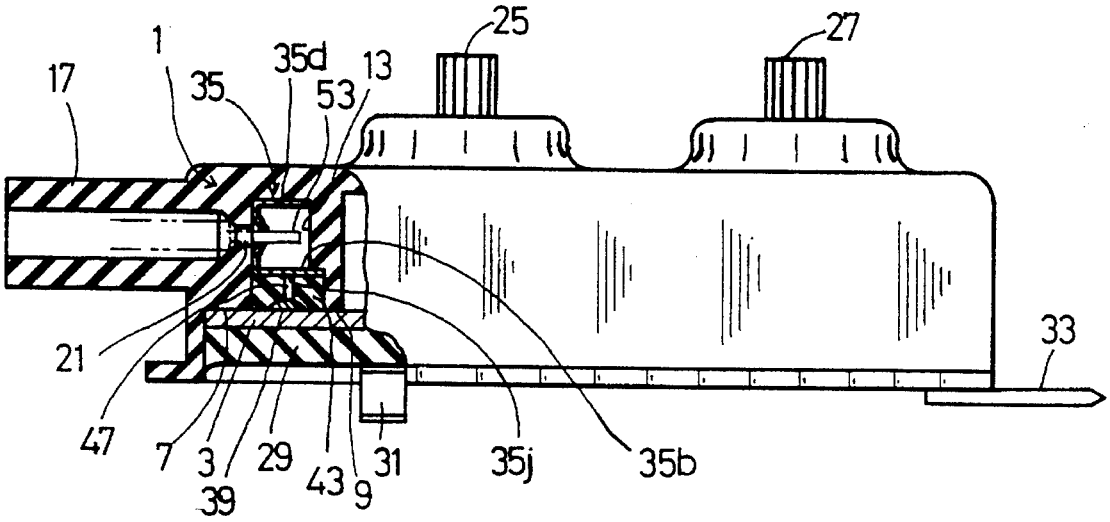
FIG. 1 is a partly sectional view showing an embodiment of a high-voltage variable resistor according to the present invention.
Figure 2:
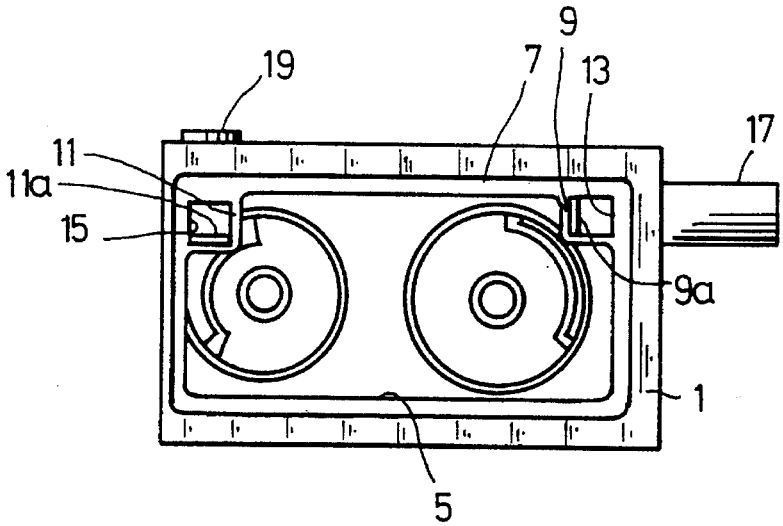
FIG. 2 is a bottom view showing an insulating casing.
Figure 3:
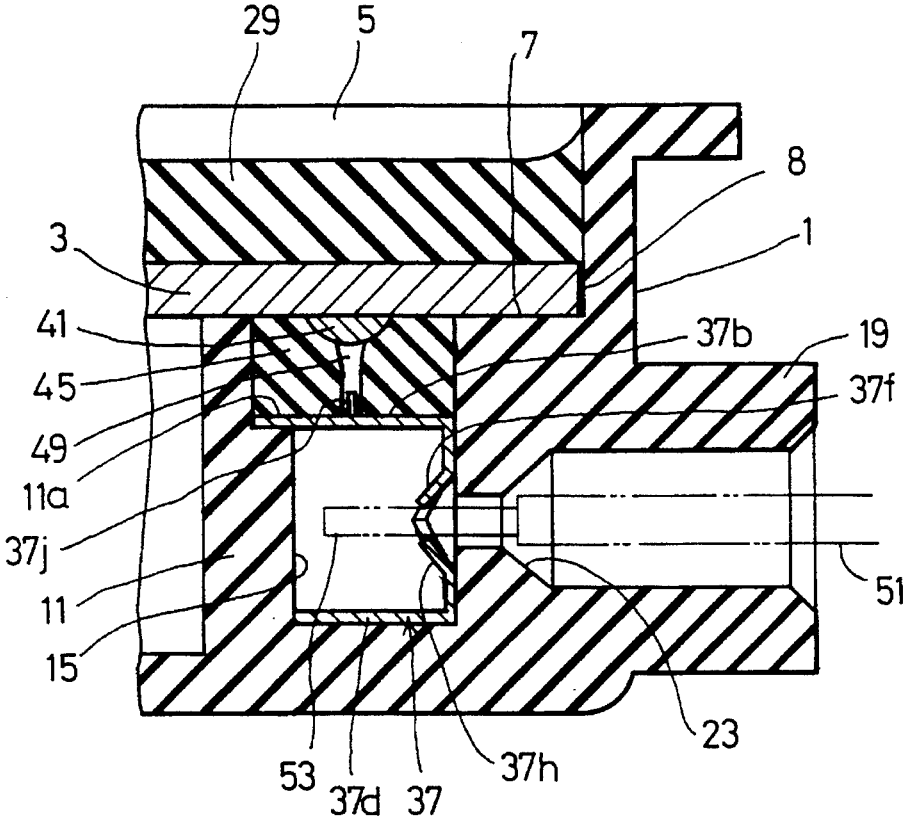
FIG. 3 is an enlarged sectional view showing an output section of a screen output section.

Referring now to FIGS. 1 to 3, an embodiment of a high-voltage variable resistor according to the present invention is illustrated, which is adapted to suitably used for adjustment of a focusing voltage of a CRT and its screen voltage and generally called a focusing pack. A high-voltage variable resistor of the illustrated embodiment includes an insulating casing 1 integrally formed of an insulating resin material such as polyphenylene oxide resin, for example, commercially available under the trademark "Noryl", polybutylene terephthalate resin or the like. Reference numeral 3 designates an insulating substrate for a circuit or a circuit substrate made of a ceramic material, on which a circuit pattern is formed. The circuit pattern may include an input electrode, a focusing output electrode. a screen output electrode, an earth electrode, a resistor for adjusting a focusing voltage, a resistor for adjusting a screen voltage and the like.

The insulating casing 1 is formed at one end thereof on a bottom side thereof with an opening and provided therein with a circuit substrate receiving section 5. Also, the insulating casing 1 is formed on an inner periphery thereof with a circuit substrate fixing rib 7 in a manner to extend over the whole periphery. The circuit substrate 3 is jointed to the circuit substrate fixing rib 7 by means of a silicone resin adhesive material 8. In addition, the rib 7 is integrally provided with an anti-discharge ribs 9 and 11 in a manner to extend so as to surround the focusing output electrode and screen output electrode incorporated in the circuit pattern on the circuit substrate 3 while keeping the circuit substrate 3 joined to the rib 7, so that the ribs 9 and 11 partition the circuit substrate receiving section 5 to provide terminal fitment receiving sections 13 and 15 in the circuit substrate receiving section 5. The insulating casing 1 is integrally formed on an outer surface thereof with lead wire inserting cylinders 17 and 19 in a manner to correspond to the terminal fitment receiving portions 13 and 15. The insulating casing 1 is formed at portions thereof positionally corresponding to the cylinders 17 and 19 with through-holes 21 and 23 extending through a wall defining the insulating casing 1, resulting in communicating with the cylinders 17 and 19. The terminal fitment receiving sections 13 and 15 are adapted to receive terminal fitments 35 and 37 therein, respectively, which will be described in detail hereinafter.

Between an inner surface of the insulating casing 1 and a front surface of the circuit substrate 3 is defined a space for rotatably receiving two sliding elements (not shown). Reference numerals 25 and 27 each designate an operation shaft which is arranged so as to rotatably extend through an upper portion of the insulating casing 1 for operating each of the sliding elements from an outside of the insulating casing 1. The circuit substrate 3 is provided on a rear surface thereof with an insulating resin layer 29 made of thermosetting resin of insulating properties such as flexible epoxy resin or the like. In the insulating resin layer 29 thus formed is partially embedded a terminal fitment 31 for input, which will be likewise described in detail hereinafter. Reference numeral 33 designates an earth terminal connected by soldering to an earth electrode of which one end is formed on the circuit substrate 3. The high-voltage variable resistor of the illustrated embodiment thus constructed is mounted on a side surface of a flyback transformer. On the insulating resin layer 29, a hard epoxy resin material to be charged in a casing of the flyback transformer is charged.

The terminal fitments 35 and 37 briefly described above each are formed by bending a stainless steel sheet cut into a predetermined shape and are constructed so as to permit a core of a lead wire to be connected thereto without soldering. In the illustrated embodiment, electrical connection between the terminal fitments 35, 37 and electrodes 39, 41 on the circuit pattern is carried out through conductive rubber members 43 and 45 each of which is an elastic conductive connection member made of a conductive rubber. The conductive rubber members 43 and 45 each are formed into a cylindrical or pillar shape, to thereby being readily inserted into the terminal fitment receiving section because of lacking any directionality. Nevertheless, the conductive rubber members 43 and 45 each may be formed into a prism-like or spherical shape. The conductive rubber members 43 and 45 are formed with through-holes 47 and 49 extending through a center thereof in an axial direction thereof, respectively.

Figure 4:
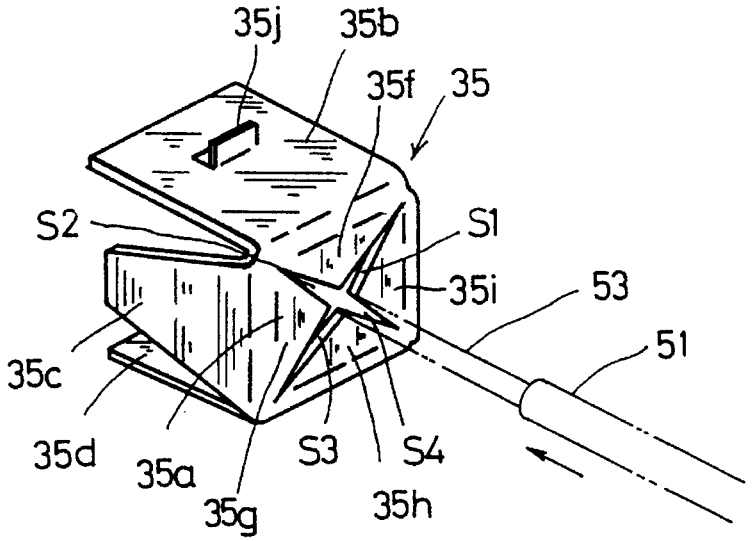
FIG. 4 is a perspective view showing an example of a terminal fitment.
Figure 5:
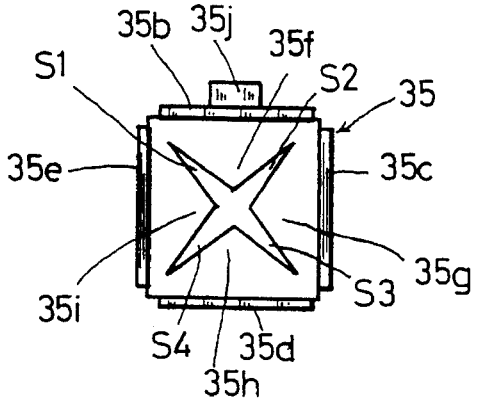
FIG. 5 is a rear view of the terminal fitment shown in FIG. 4.
Figure 6:
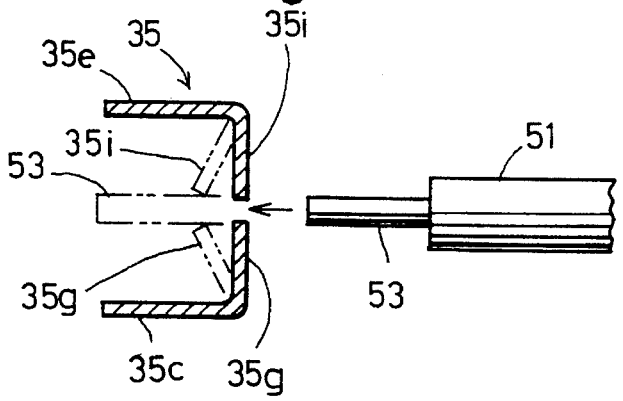
FIG. 6 is a schematic view showing the manner of connection of a core of a lead wire to the terminal fitment shown in FIG. 4.

The terminal fitments 35 and 37 are formed into the same configuration, therefore, the following description will be made on only the terminal fitment 35 with reference to FIGS. 4 to 6. The terminal fitment 35 is constructed of a plate-like section **35*a* of a square-like shape formed with a core holding section for holding a core 53 of a lead wire 51 and four wall sections 35*b* to 35*e* each connected at one end thereof to each of sides of the plate-like section 35*a* so as to extend therefrom in a direction of insertion of the lead wire 51 into the terminal fitment 35. The plate-like section 35*a* is formed with four slits S1 to S4 in a manner to radially extend from a center thereof toward corners thereof. The four slits S1 to S4 are arranged in a manner to converge together at the center of the plate-like section 35*a*, so that four edge elements 35*f* to 35*i* of a triangular or V shape each having a pointed or sharpened distal end forming an apex of a triangle each may be formed between each adjacent two of the slits S1 to S4. This results in each of the four edge elements 35*f* to 35*i* being adapted to bite at the pointed distal end thereof into a peripheral surface of the core 53 of the lead wire 51 when it is inserted into the terminal fitment 35. The four triangle edge elements 35*f* to 35*i* are arranged so as to obliquely extend in the direction of insertion of lead wire 51 into the terminal fitment 35, An angle at which each of the edge elements is inclined is determined so as to permit a distance between the distal ends of the edge elements opposite to each other to be decreased as compared with a diameter of the core 53 of the lead wire 51. Such oblique arrangement of the edge elements 35*f* to 35*i* permits the core 53 of the lead wire 51 to be readily guided along the center of the terminal fitment 35 and facilitates insertion of the core 53 of the lead wire 51 into the terminal fitment. When the high-voltage variable resistor is applied to a lead wire including a core which exhibits significantly increased rigidity, it is not necessarily required to incline the edge elements 35*f* to 35*i* because the rigidity permits the core 53 of the lead wire 51 to be inserted into the terminal fitment while forcibly inclining the edge elements. As described above, the distal end of each-of the edge elements forming an apex of a triangle is sharpened or pointed, so that application of drawing force to the core 53 of the lead wire 51 inserted into the terminal fitment 35 permits the pointed distal end of each of the edge elements 35*f* to 35*i* to firmly bite into the core, to thereby prevent the core 53 from being released from the edge element. Also, biting of the edge elements 35*f* to 35*i* into the core 35 is carried out in all directions, thus, the core 35 into which the edge elements bite once is effectively prevented from being released therefrom even when drawing force is obliquely applied to the core 35**.

Of the four wall sections **35*b* to 35*e* extending from the four sides of the plate-like section 35*a* in the direction of insertion of the lead wire 51, the wall section 35*b* contacted with the conductive rubber member 43 is formed so as to be increased in dimension defined in the direction of insertion of the core or length as compared with the other wall sections and is raised at a part thereof to provide an engagement 35*j*. The engagement 35*j* is inserted into a through-hole 47 formed through the conductive rubber member 43 via one end thereof. In correspondence to such formation of the wall section 35*b* into a larger length, the anti-discharge rib 9 is formed on an inner surface thereof with a step 9*a* on which a distal end of the wall section 35*b* is supportedly placed. Likewise, the anti-discharge rib 11 is formed with a step 11*a*. Such construction of the terminal fitment 35 permits the terminal fitment 35 to be inserted into the terminal fitment inserting section 13 only when the plate-like section 35*a* is arranged so as to be opposite to the inner end of the through-hole 21 formed via the insulating casing 1. This effectively prevents the terminal fitment 35 from being inserted into the terminal fitment receiving section 13 in a wrong posture. Also, the wall section 35***b* is supported at the distal end thereof on the step 9*a* of the anti-discharge rib 9, therefore, elastic force of the conductive rubber member 43 kept compressed between the circuit substrate 3 and the terminal fitment 35 prevents deformation of the terminal fitment 35.

In the illustrated embodiment, the terminal fitment 35 is provided with the engagement 35*j* acting as a positioning projection and correspondingly the conductive rubber member 43 is provided with the through-hole 47 acting as a positioning recess fittedly engaged with the projection. Alternatively, the illustrated embodiment may be so constructed that the wall section 35*b* of the terminal fitment 35 is provided with a through-hole or a recess and the conductive rubber member 43 is provided with a projection fittedly engaged with the through-hole or recess.

Figure 7:
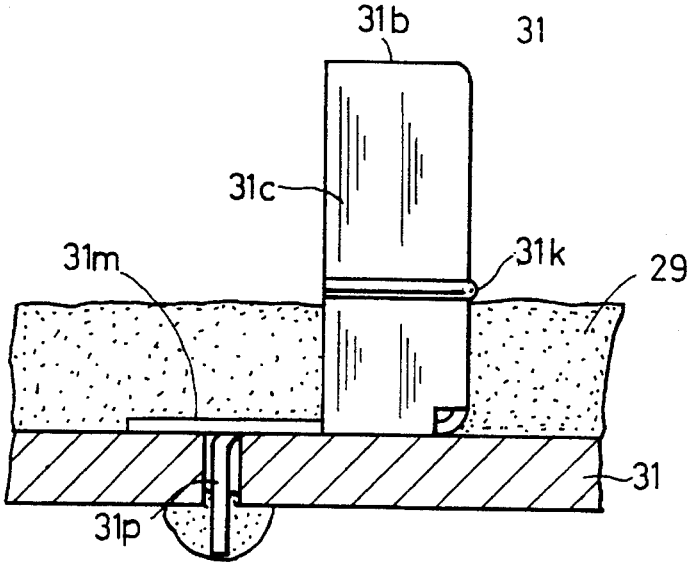
FIG. 7 is a fragmentary sectional view showing mounting of a terminal fitment for input in the high-voltage variable resistor shown in FIG. 1.
Figure 8:
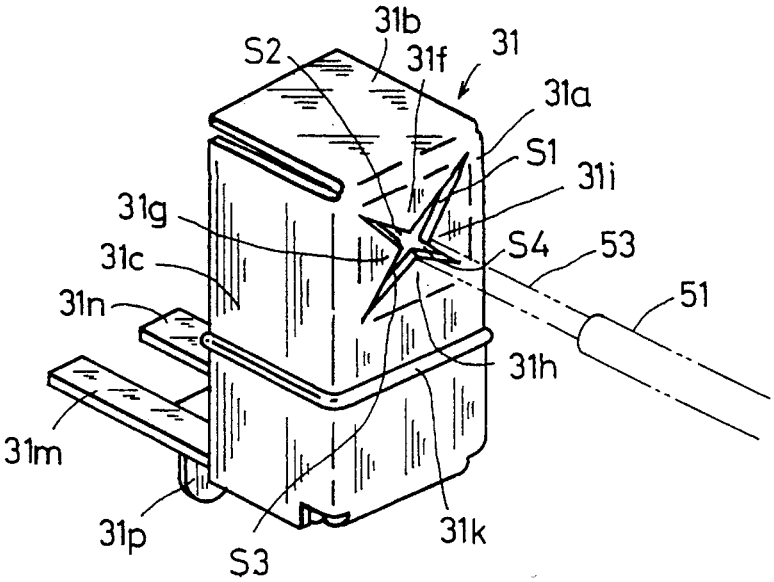
FIG. 8 is a perspective view of the terminal fitment shown in FIG. 7.
Figure 9:
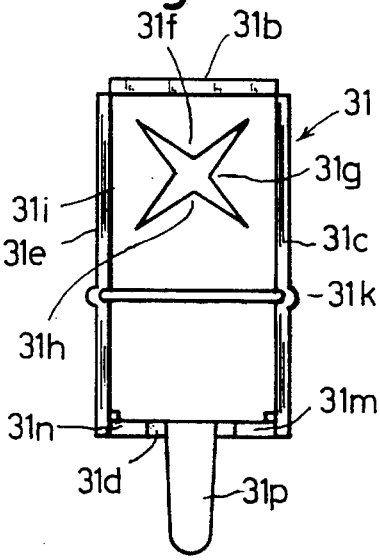
FIG. 9 is a rear view of the terminal fitment shown in FIG. 7.
Figure 10:
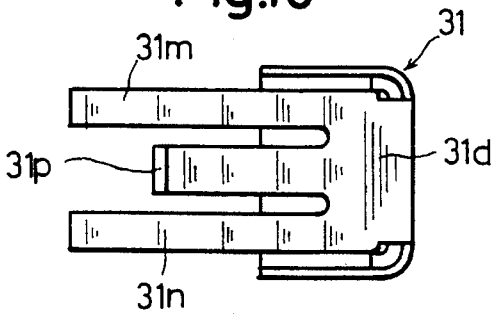
FIG. 10 is a bottom view of the terminal fitment shown in FIG. 7.

The terminal fitment 31 to which a lead wire for input extending from the flyback transformer (not shown) is connected is disposed on a rear surface of the circuit substrate 3 in such a manner as shown in FIG. 7. Now, the terminal fitment 31 for input will be described hereinafter with reference to FIGS. 8 to 10 as well as FIG. 7, wherein parts of the terminal fitment 31 corresponding to those of the terminal fitment 35 are designated by like reference numerals. The terminal fitment 31 is adapted to be embedded at a part thereof in the insulating resin layer 29, thus, the three wall sections 31*a*, 31*c* and 31*e* of the terminal fitment 31 are formed into an increased vertical dimension or height. The wall sections 31*a*, 31*c* and 31*e* each are formed thereon with a strip-like projection 31*k* acting as a mark for indicating a limit position of charging of insulating resin for the insulating resin layer 29. Absence of such a mark causes excessive charging of the insulating resin, leading to an excessive increase in thickness of the insulating resin layer 29. In the worst case, this causes the slits S1 to S4 to be partially embedded in or put out of sight by the resin charged, leading to a failure in insertion of the core 53 of the lead wire 51 into the terminal fitment. Alternatively, the mark may be formed by a groove or a line. However, when it is required to prevent the insulating resin from rising toward the slits due to surface tension, the mark is preferably formed by the strip-like projection 31*k* outwardly projected as in the illustrated embodiment.

The wall section 31*d* which constitutes a bottom of the terminal fitment 31 and through which the terminal fitment 31 is fixed on the circuit substrate 3 is formed with a pair of legs 31*m* and 31*n* and a connection end 31*p*. The legs 31*m* and 31*n* in a pair are arranged so as to be positioned along a rear surface of the circuit substrate 3 when the high-voltage variable resistor is assembled. The connection end 31*p* is formed into an L-shape and arranged so as to be projected at a distal portion thereof through the circuit substrate 3 from the front surface of the circuit substrate, followed by being connected to an input electrode (not shown) of the circuit pattern by soldering.

Figure 11:
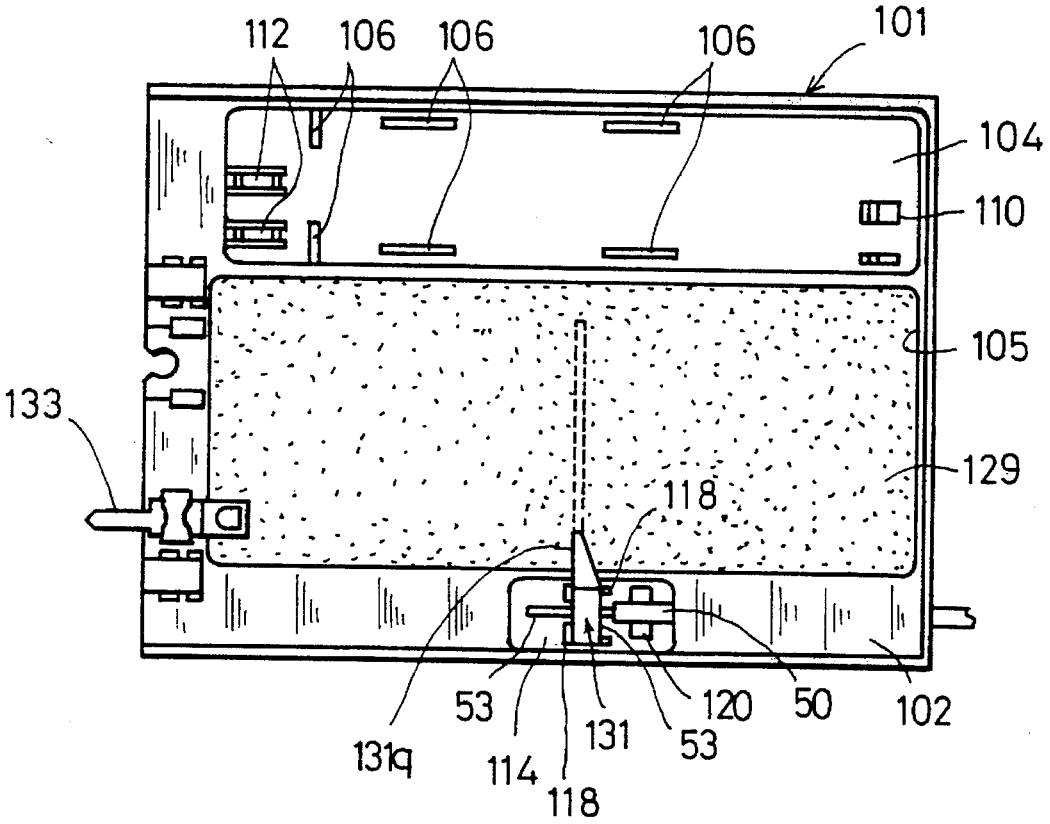
FIG. 11 is a bottom view showing another embodiment of a high-voltage variable resistor according to the present invention.
Figure 12:
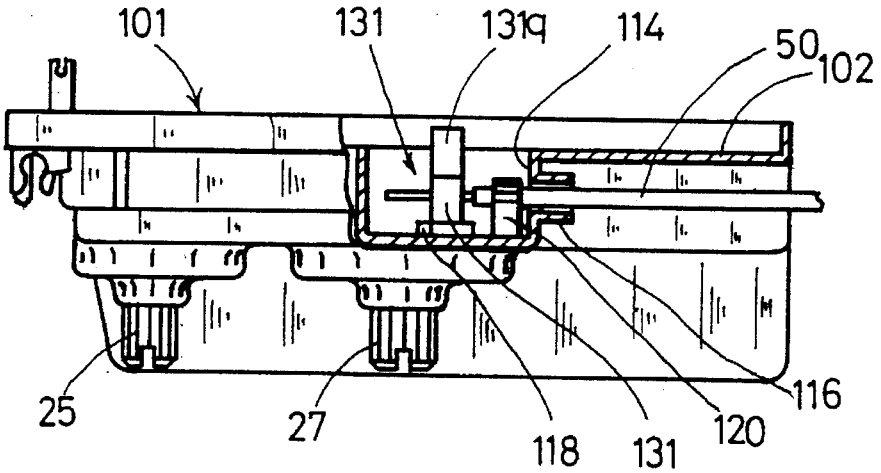
FIG. 12 is a partly cutaway side elevation view of the high-voltage variable resistor shown in FIG. 11.

Referring now to FIGS. 11 and 12, another embodiment of a high-voltage variable resistor according to the present invention is illustrated, wherein parts corresponding to those of the embodiment shown in FIGS. 1 to 10 are designated by reference numerals each comprising the figure of hundred and each number of two figures used for indicating each of the corresponding parts in the embodiment of FIGS. 1 to 10. In a high-voltage variable resistor of the illustrated embodiment, an insulating casing 101 includes, in addition to a circuit substrate receiving section 105, a capacitor receiving section 104. In general, a capacitor is required to be placed under strict quality control. Thus, a capacitor is generally received in a high-voltage variable resistor immediately before the resistor is mounted on a flyback transformer. Thus, a high-voltage variable resistor is not sold while keeping a capacitor incorporated therein. In the illustrated embodiment, a capacitor received in the capacitor receiving section 104 is connected in parallel between a focusing electrode and an earth electrode 133. The capacitor receiving section 104 is provided on a bottom thereof with projections 106 in order to support the capacitor while keeping it lifted from the bottom, to thereby permit resin to be uniformly spread over the capacitor receiving section 104. Reference numerals 110 and 112 each indicate a holder for holding a lead wire of the capacitor thereon.

Also, the illustrated embodiment is constructed in such a manner that a terminal electrode 131 for input is not fixedly embedded in an insulating resin layer 129 on a rear surface of a circuit substrate (not shown) but received in a terminal electrode receiving section 114 provided at a flange 102 of the insulating casing 101. The terminal electrode receiving section 114 is integrally provided on a side thereof with a cylindrical section 116 into which a lead wire for input is inserted. Also, the terminal electrode receiving section 114 is integrally provided with a pair of projections 118 for forming a fitment section therebetween in which the terminal electrode 131 is fitted, as well as a lead wire fitting section 120 including a fitment groove in which a cover of a lead wire 51 is fitted.

Figure 13:
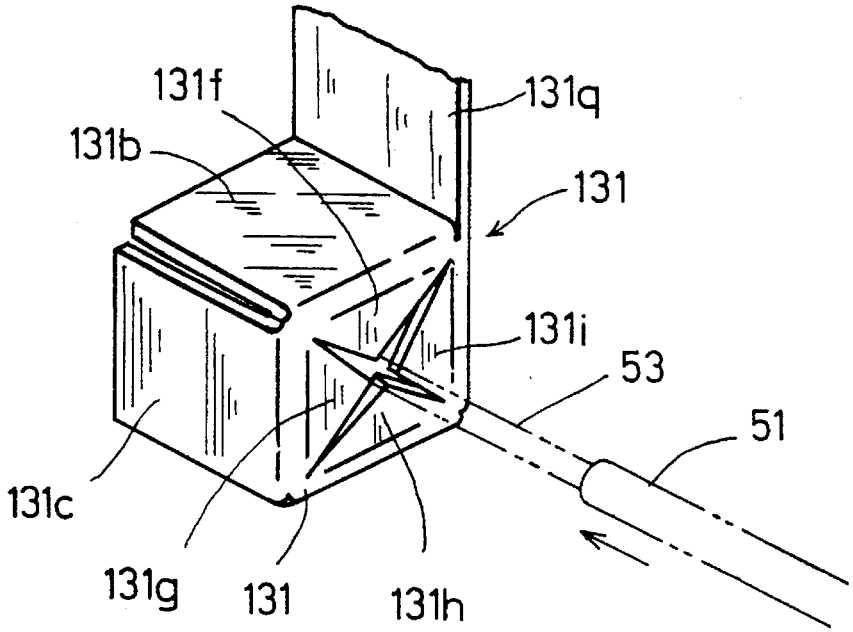
FIG. 13 is a perspective view showing an essential part of a terminal electrode.
Figure 14:
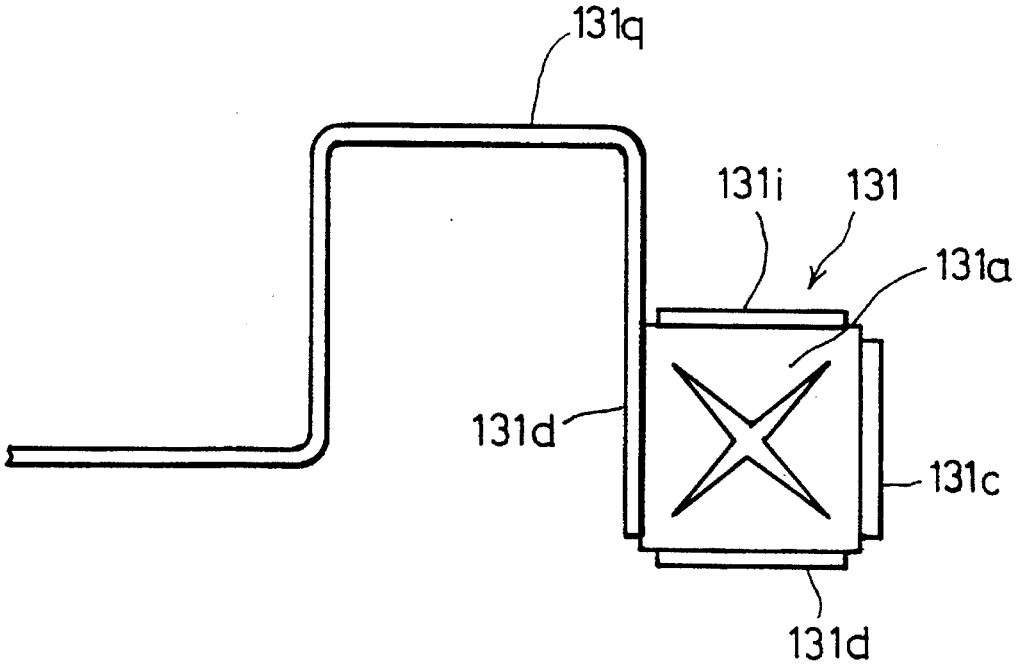
FIG. 14 is a rear view showing another essential part of the terminal electrode shown in FIG. 13.

FIGS. 13 and 14 show an essential part of the terminal electrode 131. The essential part of the terminal electrode 131 is basically constructed in substantially the same manner as the terminal electrode 35 shown in FIGS. 4 to 6, except that a connection conductor 131*q* for connection with an input electrode arranged on a front surface of the circuit substrate (not shown) is connected to a side wall section 131*d* of the terminal electrode 131. The connection conductor 131*q* includes a section arranged so as to straddle a wall separating the substrate receiving section 105 and terminal electrode receiving section 114 from each other, a section embedded in the insulating resin layer 129 and a section arranged so as to penetrate the circuit substrate and connected to the input electrode on the front surface of the circuit substrate by soldering. The side wall sections 131*a* and 131*d* of the terminal electrode 131 are interposedly held between the projections 118 in the terminal electrode receiving section 114, to thereby effectively prevent the terminal electrode 131 from being moved during pouring of insulating resin to the rear surface of the circuit substrate to form the insulating resin layer 129. When the high-voltage variable resistor is combined with a flyback transformer, resin for molding the flyback transformer is charged in the terminal electrode receiving section 114 as well.

Each of the embodiment described above permits a lead wire to be held in the terminal electrode irrespective of a thickness of the lead wire and without changing a structure of the terminal electrode.

While preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor comprising:

a circuit substrate having a circuit pattern formed on a front surface thereof;

an insulating casing made of an insulating resin material and provided therein with a circuit substrate receiving section open at one end thereof;

said circuit substrate being received in said circuit substrate receiving section of said insulating casing and arranged so as to define a space between an inner surface of said insulating casing and said front surface of said circuit substrate;

at least one sliding element arranged in said space in a manner to be operable from an outside of said insulating casing; and at least one terminal fitment to which a core of a lead wire is connected without soldering and which is electrically connected to an electrode incorporated in said circuit pattern;

said terminal fitment including a core holding section provided with four edge elements each having a pointed distal end adapted to bite into a periphery of the core of the lead wire inserted;

said edge elements each being formed between each adjacent two of four slits formed at a plate-like section of said terminal fitment so as to radially extend from a center of said plate-like section;

said plate-like section being formed into a substantially rectangular configuration;

said four slits being formed so as to extend toward corners of said plate-like section, respectively;

said edge elements each being constructed so as to be forced by the core of the lead wire when the core is inserted through said center of said plate-like section into said terminal fitment, to thereby be inclined in a direction of insertion of the core into said terminal fitment and bite into the periphery of the core of the lead wire when drawing force is applied to the lead wire.

2. A high-voltage variable resistor as defined in claim 1, wherein said terminal fitment includes a wall section arranged so as to extend from each of at least three sides of said plate-like section in the direction of insertion of the core.

3. A high-voltage variable resistor as defined in claim 1, wherein each two of said edge elements positioned opposite to each other are arranged so as to define therebetween an interval smaller than a diameter of the core of the lead wire.

4. A high-voltage variable resistor as defined in claim 1, wherein said edge elements each are previously inclined in the direction of insertion of the core of the lead wire into said terminal fitment.

5. A high-voltage variable resistor as defined in claim 1, wherein said insulating casing includes at least one terminal fitment receiving section for receiving said terminal fitment therein;

said terminal fitment being connected through a conductive connection member to said electrode on said circuit substrate.

6. A high-voltage variable resistor as defined in claim 1 or 2, wherein said circuit substrate receiving section of said insulating casing is provided therein with a terminal fitment receiving section for receiving said terminal fitment therein;

said terminal fitment receiving section being defined by a wall means;

said wall means being formed with a through-hole through which the core of the lead wire is inserted thereinto;

said terminal fitment being received in said terminal fitment receiving section so as to cause said core holding section to be opposite to an inner end of said through-hole;

said terminal fitment being electrically connected through an elastic conductive connection member to said electrode on said circuit substrate.

7. A high-voltage variable resistor as defined in claim 1, wherein said insulating casing is provided therein with a terminal fitment receiving section for receiving said terminal fitment therein in a manner to be adjacent to said circuit substrate receiving section;

said terminal fitment receiving section being defined by a wall means;

said wall means being formed with a through-hole through which the core of the lead wire is inserted thereinto;

said terminal fitment being received in said terminal fitment receiving section so as to cause said core holding section to be opposite to an inner end of said through-hole;

said terminal fitment being electrically connected through a conductive connection member to said electrode on said circuit substrate.

8. A high-voltage variable resistor as defined in claim 1, wherein said terminal fitment is disposed on a rear surface of said circuit substrate; and said terminal fitment has a connection terminal arranged so as to extend through said circuit substrate to the front surface of said circuit substrate and connected to said electrode by soldering.

9. A high-voltage variable resistor comprising:

a circuit substrate having a circuit pattern formed on a front surface thereof;

an insulating casing made of an insulating resin material and provided therein with a circuit substrate receiving section open at one end thereof and at least one terminal fitment receiving section;

a circuit substrate fixing rib which is provided on an inner periphery of said circuit substrate receiving section for supporting said circuit substrate thereon in a manner to define a space between said front surface of said circuit substrate and an inner surface of said rib and to which said circuit substrate is attached by means of an adhesive;

said circuit substrate receiving section being partitioned by at least one anti-discharge rib connected at both ends thereof to said circuit substrate fixing rib and arranged so as to surround an electrode incorporated in said circuit pattern on said circuit substrate while keeping said circuit substrate received therein;

said insulating casing being formed with a through-hole extending from an outer surface of said insulating casing to said circuit substrate receiving section;

at least one sliding element arranged in said space in a manner to be operable from an outside of said insulating casing;

an insulating resin layer formed of insulating resin charged on a rear surface of said circuit substrate; and at least one terminal fitment which is received in said at least one terminal fitment receiving section and to which a core of a lead wire is connected without soldering;

said terminal fitment being electrically connected to the electrode incorporated in said circuit pattern through an elastic conductive connection member;

said terminal fitment including a core holding section provided with four edge elements each having a pointed distal end adapted to bite into a periphery of the core of the lead wire inserted;

said edge elements each being formed between each adjacent two of four slits formed at a plate-like section of said terminal fitment so as to radially extend from a center of said plate-like section;

said plate-like section being formed into a substantially rectangular configuration;

said four slits being formed so as to extend toward corners of said plate-like section, respectively;

said edge elements each being constructed so as to be forced by the core of the lead wire when the core is inserted through said center of said plate-like section into said terminal fitment, to thereby be inclined in a direction of insertion of the core into said terminal fitment and bite into the periphery of the core of the lead wire when drawing force is applied to the lead wire.

10. A high-voltage variable resistor as defined in claim 9, wherein said conductive connection member comprises a conductive rubber member arranged between said circuit substrate and said terminal fitment while being kept compressed;

one of said terminal fitment and conductive connection section being formed with a positioning projection means and the other being formed with a positioning recess means fittedly engaged with said positioning projection means.

11. A high-voltage variable resistor as defined in claim 9, wherein said terminal fitment includes a wall section extending from each of sides of said plate-like section in the direction of insertion of the core of the lead wire into said terminal fitment.

12. A high-voltage variable resistor comprising:

a circuit substrate having a circuit pattern formed on a front surface thereof;

an insulating casing made of an insulating resin material and provided therein with a circuit substrate receiving section open at one end thereof;

said circuit substrate being received in said circuit substrate receiving section of said insulating casing and arranged so as to define a space between an inner surface of said insulating casing and said front surface of said circuit substrate;

at least one sliding element arranged in said space in a manner to be operable from an outside of said insulating casing;

an insulating resin layer formed of insulating resin charged on a rear surface of said circuit substrate; and at least one terminal fitment to which a core for a lead wire is connected without soldering;

said terminal fitment being fixed on said rear surface of said circuit substrate and being partially embedded in said insulating resin layer;

said terminal fitment including a connection section connected through said circuit substrate to an electrode incorporated in said circuit pattern by soldering;

said terminal fitment being formed therein with a core holding section which is provided with four edge elements each having a pointed distal end adapted to bite into a periphery of the core of the lead wire;

said edge elements each being formed between each adjacent two of four slits formed at a plate-like section of said terminal fitment so as to radially extend from a center of said plate-like section;

said plate-like section being formed into a substantially rectangular configuration;

said four slits being formed so as to extend toward corners of said plate-like section, respectively;

said edge elements each being constructed so as to be forced by the core of the lead wire when the core is inserted into said terminal fitment, to thereby be inclined in a direction of insertion of the core into said terminal fitment and bite into the periphery of the core of the lead wire when drawing force is applied to the lead wire.

13. A high-voltage variable resistor as defined in claim 12, wherein a portion of said terminal fitment in which said core receiving section is formed is formed thereon with a mark indicating a limit position of charging of the insulating resin for said insulating resin layer.

* * * * *